US011326442B1

(12) United States Patent
Bryant

(10) Patent No.: US 11,326,442 B1
(45) Date of Patent: May 10, 2022

(54) ORIENTATION VERIFICATION DEVICES

(71) Applicant: HALLIBURTON ENERGY SERVICES, INC., Houston, TX (US)

(72) Inventor: Camille Anne Bryant, Cleburne, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/092,695

(22) Filed: Nov. 9, 2020

(51) Int. Cl.

| | |
|---|---|
| ***E21B 47/002*** | (2012.01) |
| ***E21B 47/024*** | (2006.01) |
| ***E21B 43/117*** | (2006.01) |
| *E21B 17/05* | (2006.01) |
| *E21B 43/11* | (2006.01) |

(52) U.S. Cl.
CPC ..... *E21B 47/024* (2013.01); *E21B 43/117* (2013.01); *E21B 47/002* (2020.05); *E21B 17/05* (2013.01); *E21B 43/11* (2013.01)

(58) Field of Classification Search
CPC ..... E21B 43/11; E21B 43/117; E21B 47/024; E21B 47/002; E21B 17/05
See application file for complete search history.

(56) References Cited

U.S. PATENT DOCUMENTS

| | | | | |
|---|---|---|---|---|
| 3,052,784 | A * | 9/1962 | Ousley | F42C 19/06 200/564 |
| 4,011,815 | A * | 3/1977 | Garcia | E21B 43/117 175/4.51 |
| 6,173,773 | B1 | 1/2001 | Almaguer et al. | |
| 6,679,327 | B2 | 1/2004 | Sloan et al. | |
| 7,000,699 | B2 | 2/2006 | Yang et al. | |
| 7,044,236 | B2 | 5/2006 | Iversen et al. | |
| 7,147,060 | B2 | 12/2006 | Huber et al. | |
| 8,365,814 | B2 | 2/2013 | Hill et al. | |
| 9,115,572 | B1 | 8/2015 | Hardesty et al. | |
| 10,731,443 | B2 * | 8/2020 | Von Kaenel | E21B 43/117 |
| 11,181,659 | B2 * | 11/2021 | Fouda | E21B 47/00 |
| 2011/0024117 | A1 | 2/2011 | Lopez De Cardenas et al. | |
| 2017/0198559 | A1 * | 7/2017 | Golian | E21B 43/117 |

FOREIGN PATENT DOCUMENTS

| | | | |
|---|---|---|---|
| EP | 3006663 | A2 | 4/2016 |
| WO | WO-2008098052 | A2 | 8/2008 |

* cited by examiner

*Primary Examiner* — Yong-Suk (Philip) Ro
(74) *Attorney, Agent, or Firm* — Haynes and Boone, LLP

(57) ABSTRACT

An orientation verification tool permits an operator to confirm an orientation of one or more perforating charges in a perforating gun assembly when the perforating charges are not readily visible for inspection. The orientation verification tool includes an end fixture rotationally coupled at a longitudinal end of a charge carrier disposed within a tubular gun body. The end fixture includes a visual indicator of the orientation of the perforating charges on a longitudinal end face thereof. The visual indicator may include a plurality of hatch marks arranged at regular intervals around the end fixture, and each hatch mark may be identified by a specific angular identifier so that the hatch mark located at a reading location will identify the angular orientation of the perforating charges.

20 Claims, 8 Drawing Sheets

ORIENTATION VERIFICATION DEVICES

BACKGROUND

The present disclosure relates generally to equipment and operations performed in conjunction with subterranean wellbores. Example embodiments described herein include tools that may be employed to ensure that perforating guns or other downhole equipment is arranged in the intended orientation when deployed into a wellbore.

Often, perforating operations are conducted in a subterranean wellbore to encourage the exchange of fluids between the wellbore and the surrounding geologic formation. Perforations may be created through casing and cement layers and some distance into the geologic formation by detonating a series of explosive shaped charges within the wellbore. The shaped charges are loaded into one or more perforating guns at a surface location, and then the perforating guns are lowered down-hole on a conveyance such as a tubing string, wire line, slick line, coil tubing, etc.

It is sometimes desirable to perforate a wellbore in a particular direction or range of directions relative to an axis of the wellbore. For example, in a deviated, inclined or horizontal wellbore it is frequently beneficial to detonate perforating charges in a downward direction. However, certain circumstances may instead make it more beneficial to perforate in an upward direction, in a particular inclination from the upward or downward direction, or in another combination or range of directions. To achieve the goal of perforating a wellbore in particular directions, the perforating charges may be assembled in a charge carrier in an appropriate orientation at the surface. Once the charge carrier is installed into a gun body, however, it may be difficult to ascertain whether the perforating charges remain in the appropriate orientation.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes an orientation verification tool that permits an operator to confirm an orientation of one or more perforating charges in a perforating gun assembly even when the perforating charges are not readily visible for inspection. The orientation verification tool may include an end fixture that is rotationally coupled to a charge carrier disposed within a gun body. The end fixture is visible from a longitudinal end of a fully assembled perforating gun assembly and includes a visual indicator of the orientation of the perforating charges. The visual indicator may include a plurality of hatch marks arranged at regular intervals around the endcap, and each hatch mark may be identified by a specific angular identifier so that the hatch mark located at a reading location will identify the angular orientation of the perforating charges. In some embodiments, the endcap may include a connector for securing a detonator or other equipment to the perforating gun, and the visual indicator may be arranged to be visible when the detonator or other equipment is secured.

An operator may assemble the endcap to a charge carrier and then insert the charge carrier into a tubular gun body. The operator may view the visual indicator prior to assembling the perforating gun assembly in a tool string to confirm that the perforating charges are arranged in the intended orientation when the tool string is deployed into the wellbore.

Figure 1:
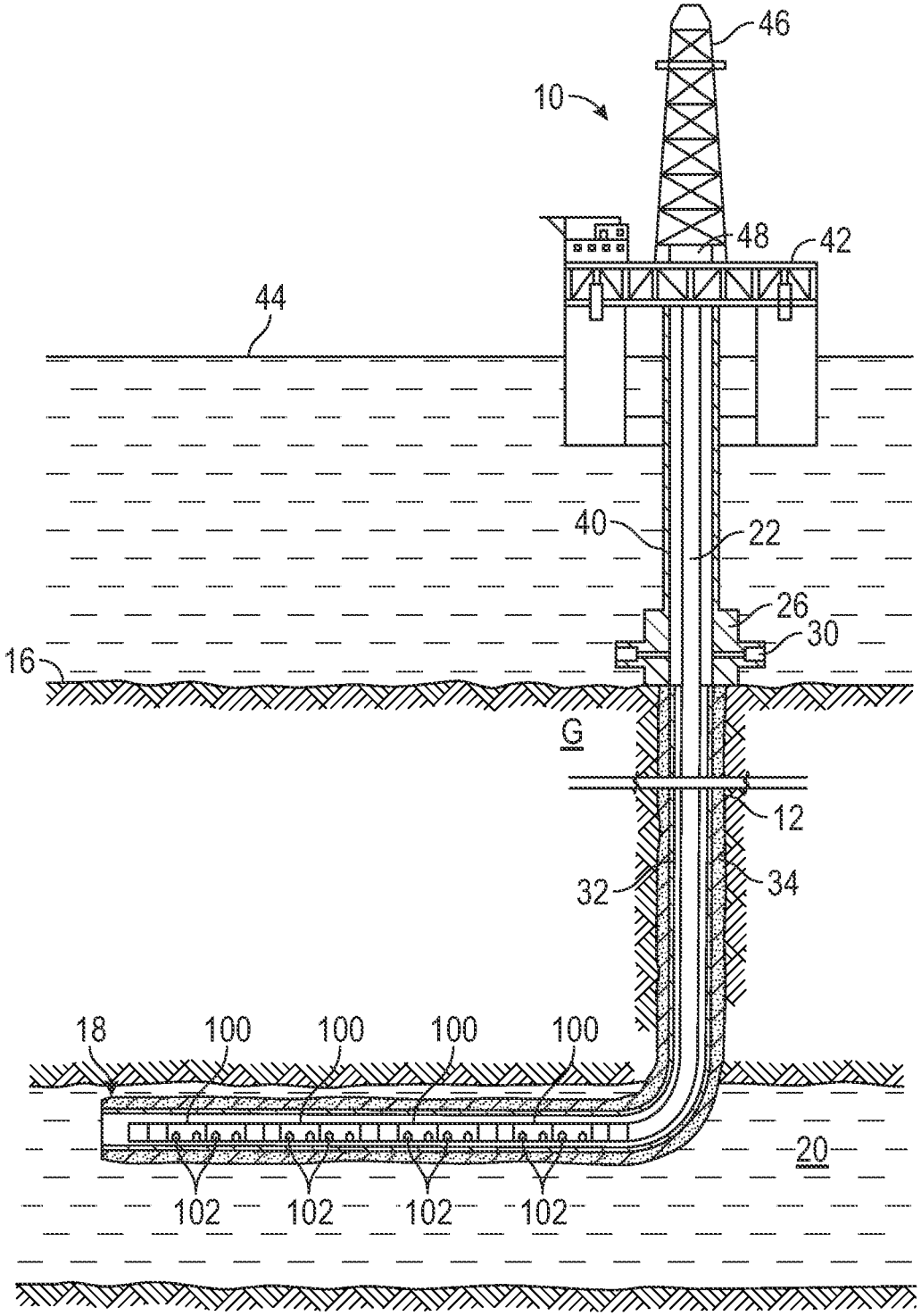
FIG. 1 is a partial, cross-sectional side view of a subsea wellbore system including a plurality of perforating gun assemblies positioned within a tool string within a horizontal portion of a wellbore in accordance with aspects of the present disclosure.

FIG. 1 illustrates a well system 10 in accordance with example embodiments of the present disclosure. In well system 10, a wellbore 12 extends from a seabed 16 through a geologic formation "G." Although well system 10 is illustrated in an offshore context, one skilled in the art will recognize that aspects of the disclosure may be practiced in terrestrial applications as well. Wellbore 12 includes a portion 18 thereof that extends through a hydrocarbon producing formation 20. Although the portion 18 of the wellbore 12 that intersects the hydrocarbon producing formation 20 is depicted as being substantially horizontal, it should be understood that the orientation of this portion 18 of the wellbore 12 is not essential to the principles of this disclosure. The portion 18 of the wellbore 12 which intersects the hydrocarbon producing formation 20 could be otherwise oriented (e.g., vertical, inclined, etc.).

A work string 22 is illustrated including a plurality of perforating gun assemblies 100. Work string 22 extends into the wellbore 12 such that perforating gun assemblies 100 are disposed within the portion 18 of the wellbore 12 extending through the hydrocarbon bearing formation 20. Work string 22 includes four perforating gun assemblies 100 coupled therein, although more or fewer perforating guns 100 may be provided. Each of the perforating gun assemblies 100 includes a plurality of perforating charges 102 arranged in a particular orientation. Specifically, each of the perforating charges 102 are arranged in a downward direction to form perforations below the horizontal portion 18 of the wellbore 12. In other embodiments, the perforating charges 102 may be arranged in another orientation, or a range of orientations, without departing from the scope of the disclosure.

The well system 10 includes a wellhead installation 26 on seabed 16, which provides pressure seals and other interfaces for the work string 22 and other tools extending into the wellbore 12. The wellhead installation 26 supports a blowout preventer 30 that is operable to contain a pressure in the wellbore 12 during sudden or unexpected pressure increases, and may also provide a suspension point for casing 32 that is cemented into the wellbore 12 with a layer of cement 34. A riser or other subsea conduit 40 extends from the wellhead installation 26 to a semi-submersible platform 42, which may float on the sea surface 44. The semi-submersible platform 42 includes a derrick 46 and a hoisting apparatus 48 for raising and lowering pipe strings such as work string 22.

When it is desired to perforate the hydrocarbon producing formation 20, work string 22 is lowered through casing 32 until the perforating guns 100 are properly positioned relative to hydrocarbon producing formation 20. Thereafter, the perforating charges 102 may be sequentially detonated, either in an up-hole to down-hole or a down-hole to up-hole direction. Perforating charges 102 are typically shaped, such as conically, to control the direction of the blast upon detonation. In this regard, upon detonation, conically shaped charges 102 form jets that create a spaced series of perforations extending downwardly outwardly through casing 32, cement layer 34 and into hydrocarbon producing formation 20, and thereby allow formation communication between hydrocarbon producing formation 20 and wellbore 12.

Figure 2B:
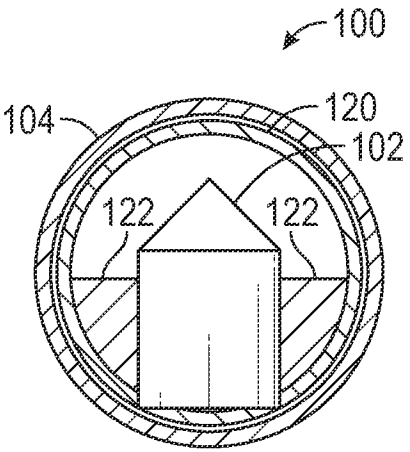
FIG. 2B is a cross sectional end view of the perforating gun assembly of FIG. 2A illustrating the perforating charges assembled in a charge carrier and a gun body surrounding the charge carrier.
Figure 2A:
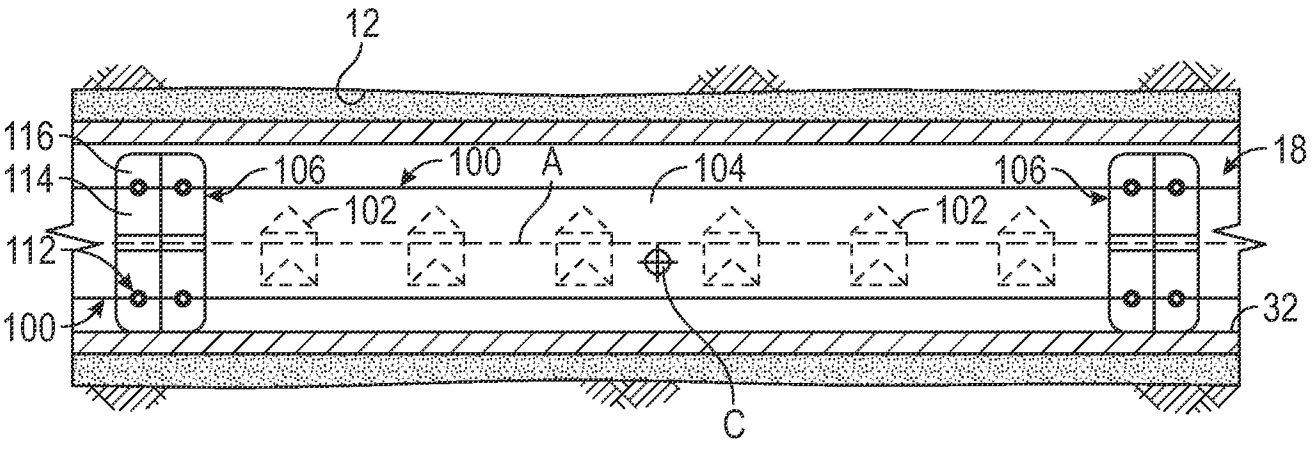
FIG. 2A is a partial, cross-sectional side view of one of the perforating gun assemblies of FIG. 1 illustrating a plurality of perforating charges oriented in a downward direction in the wellbore.

Referring to FIG. 2A, an example perforating gun assembly 100 is illustrated in the horizontal portion 18 of the wellbore 12. The perforating charges 102 are housed within a tubular gun body 104, which is supported between swivel devices 106. As illustrated, the tubular gun body 104 is supported out of contact with casing 32 by the swivel devices 106. As illustrated, the swivel devices 106 are connected at opposite ends of a single tubular gun body 104, but in other embodiments (not shown) more than one tubular gun body 104 may be coupled between the swivel devices 106. Similarly, in other embodiments, other components, such as a firing head, blank detonation transfer section, work string, etc., may also be coupled between the swivel devices 106.

The swivel devices 106 define a rotational axis "A" about which the perforating charges 102 may rotate within the wellbore 12. To permit the perforating charges 102 to be properly oriented, a center of gravity "C" of the perforating gun assembly 100 is laterally offset relative to the rotational axis "A." As depicted in FIG. 2, the center of gravity "C" is positioned directly below the rotational axis "A," thereby orienting the perforating charges 102 to discharge in the desired downward direction. If, however, the center of gravity "C" were to be rotated in either direction about the rotational axis "A," a torque due to gravitational force acting on the center of gravity "C" would operate to rotate the perforating gun charges 102 to the position illustrated in FIG. 2, in which the center of gravity "C" is directly below the rotational axis "A". The swivel devices 106 include a plurality of bearings 112 defined between an inner ring 114 and an outer ring 116. The perforating charges 102 are rotationally coupled to the inner ring 114.

As illustrated in FIG. 2B, the perforating charges 102 may be supported in a charge carrier 120 that is disposed within the tubular gun body 104. In some embodiments, both the charge carrier 120 and the tubular gun body 104 may be rotationally coupled to the inner rings 114 of the swivel devices (FIG. 2A), and in other embodiments, the charge carrier 120 may be rotationally coupled to the inner rings 114 and the tubular gun body 104 may be rotationally fixed to the outer rings 116. As illustrated in FIG. 2B, weights 122 may optionally be installed in the charge carrier 120 to facilitate offsetting the center of gravity "C" with respect to the rotational axis "A." In other embodiments (not shown), the orientation of the charge carrier 120 may be manually adjustable and may not rely on gravity.

Figure 3A:
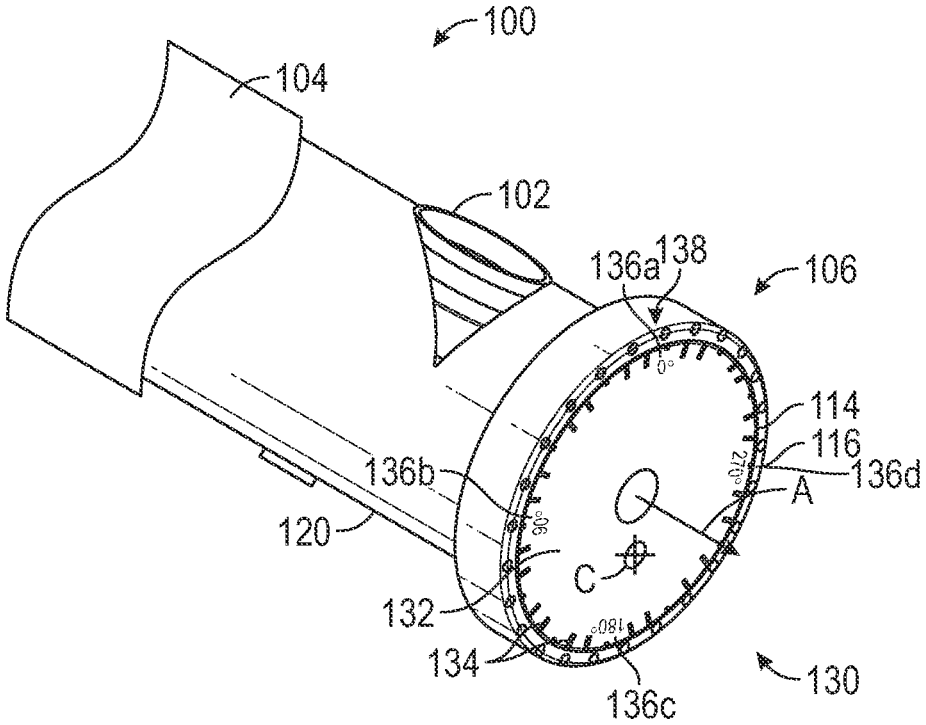
FIG. 3A is a partial, perspective view an orientation verification tool of the perforating gun assembly of FIGS. 2A and 2B indicating an upward orientation of the perforating charges.

Referring to FIG. 3, an orientation verification tool 130 of the perforating gun assembly 100 is illustrated. As indicated in FIG. 3A, the orientation verification tool 130 indicates that the perforating charges 102 are oriented in an upward orientation. The orientation verification tool 130 provides a method of verifying the angle of the perforating charges 102 without having to remove the charge carrier 120 from the tubular gun body 104 prior to assembling the perforating gun assembly 100 to the rest of the work string 22 (FIG. 1). The operation of the orientation verification tool 130 is purely mechanical and does not rely on any electronics or communication signals. For example, the orientation verification tool 136 may move in conjunction with the inner ring 114 of the swivel device 106 to indicate the orientation of the perforating charges.

The orientation verification tool 130 includes an end fixture 132 having hatch marks 134 and numerical indicators 136*a*, 136*b*, 136*c* and 136*d* of the angles of orientation embossed, inscribed or otherwise imprinted thereon. As illustrated, the hatch marks 134 may be arranged at regular 10-degree intervals around a circumference of the end fixture 132. The end fixture 132 may be fixedly secured to a longitudinal end of the charge carrier 120 with a reference numerical indicator 136*a*, for example 0°, aligned with a discharge direction of the perforating charges 102. The numerical indicators 136*b*, 136*c* and 136*d* correspond to respective an angular positions 90°, 180° and 270° of the respective numerical indicators from reference indicator 136*a*. The end fixture 132 may rotate with the charge carrier 120 about the rotational axis "A," and the reference numerical indicator 136*a* maintains its alignment with the perforating charges 102. The end fixture 132 may include a key or slot (not shown) to be engaged a corresponding key or slot (not shown) defined on the charge carrier 120 such that the end fixture 132 may not be inadvertently installed in an improper orientation with respect to the charge carrier 120.

Figure 3B:
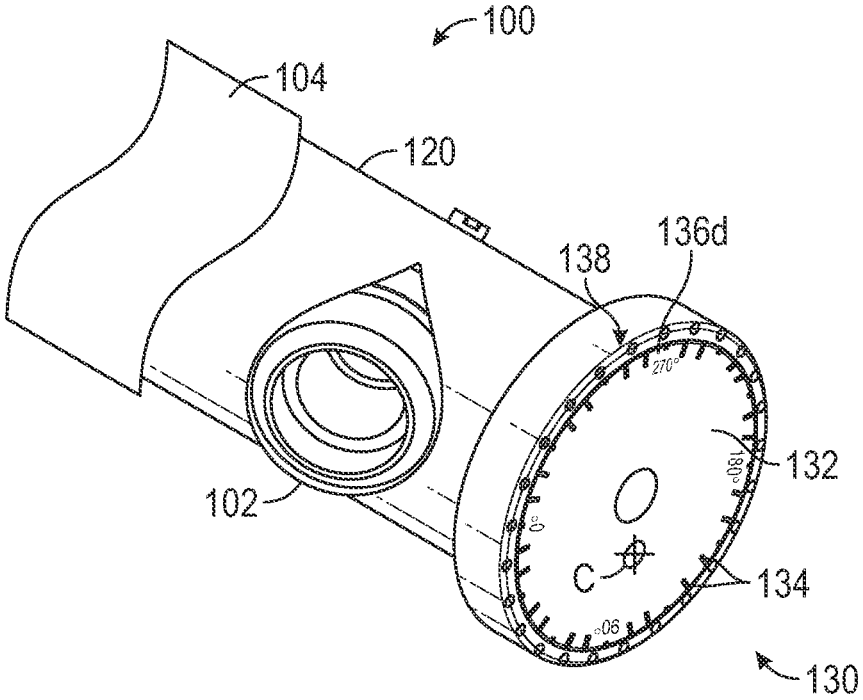
FIG. 3B is a partial, perspective view of the orientation verification tool of FIG. 3A indicating a horizontal orientation of the perforating charges.

A reading location 138 may be defined about the end fixture 132 from which the orientation of the perforating charges 102 may be ascertained. For example, the reading location 138 may be defined at an upper-most point of the outer ring 116. As illustrated in FIG. 3A, the reference numerical indicator 136*a* is aligned with the reading location 138, and the perforating charges 102 are oriented 0° from vertical. As illustrated in FIG. 3B, numerical indicator 136*d* is aligned with the reading location 138, and the perforating charges 102 are oriented at 270° from vertical. An operator may view the hatch marks 134 and numerical indicators, for example, 136*d* at the reading location 138 to ascertain the orientation of the perforating charges 102. Since the end fixture 132 is secured to the longitudinal end of the charge carrier 120, the end fixture 132 is visible from an open longitudinal end of the tubular gun body 104, even when the charge carrier 120 is assembled in the tubular gun body 104.

Figure 4B:
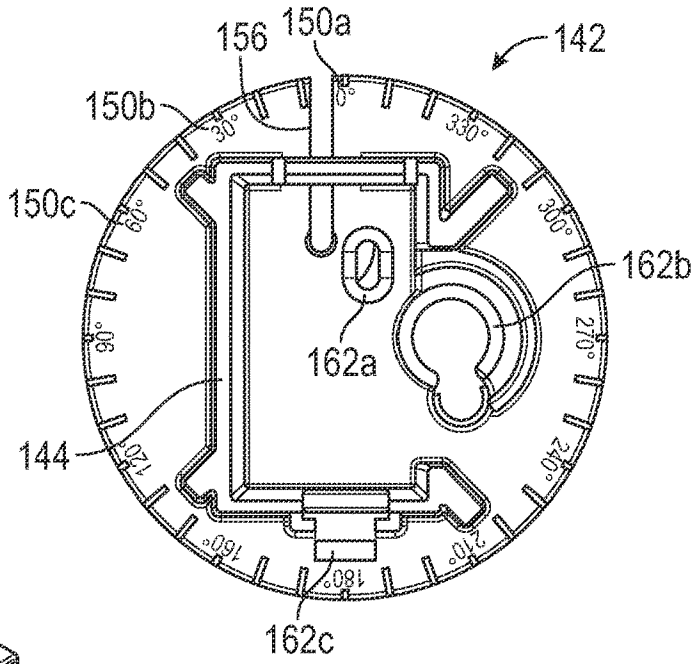
FIG. 4B is an end view of the orientation verification tool of FIG. 4A.
Figure 4A:
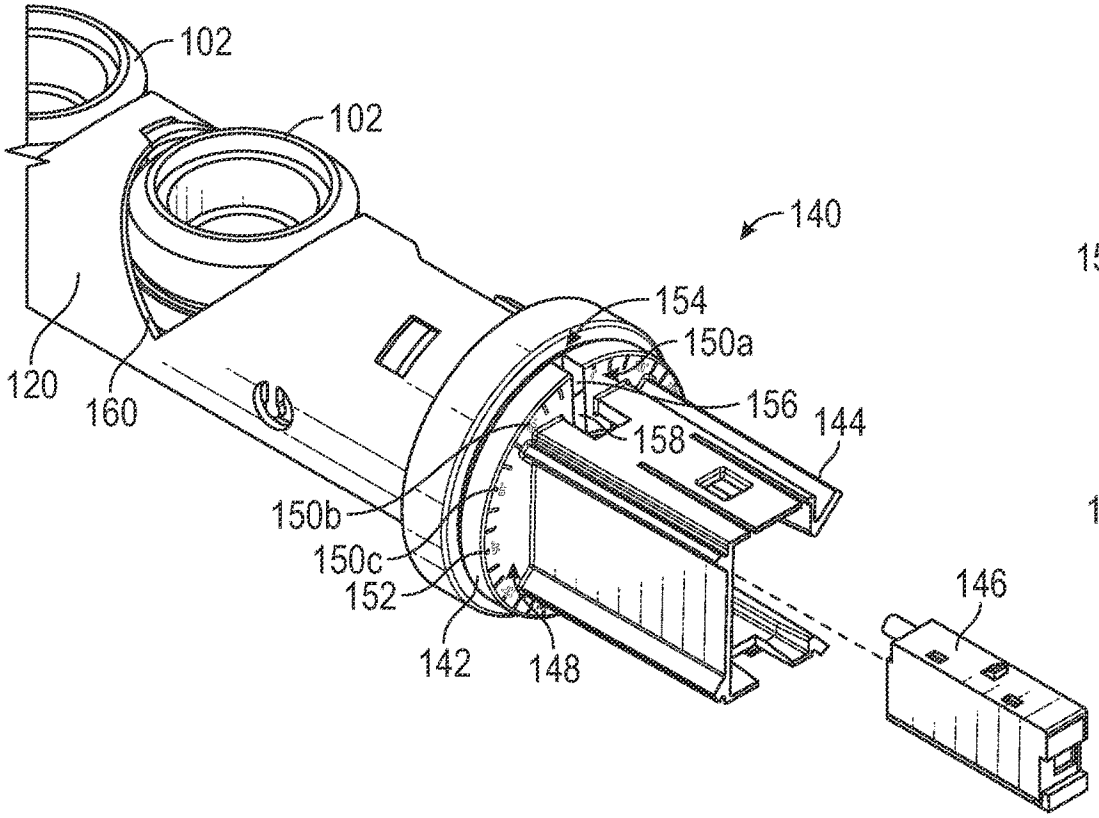
FIG. 4A is a partial, perspective view of an alternate embodiment of an orientation verification tool including a connector for securing a detonator or other equipment to a perforating gun assembly.

Referring to FIG. 4A, an orientation verification tool 140 includes an end fixture 142. The end fixture 142 includes a detonator sleeve 144 for a detonator 146 protruding longitudinally from a longitudinal end face 148 of the end fixture 142. The detonator sleeve 144 is circumscribed by numerical indicators 150*a*, 150*b*, 150*c* (collectively referred to as numerical indicators 150) and hatch marks 152, which are visible with the detonator 146 or other equipment coupled to the end fixture 142. The numerical indicators 150 and hatch marks 152 may provide an indication of the orientation of the perforating charges 102 with the detonator 146 installed and when the charge carrier 102 is installed in a tubular gun body 104 (FIG. 3A). A reference numerical indicator 150*a* may be indicate the orientation of the perforating charges 102 within a tubular gun body 104, and the hatch marks 152 and numerical indicators 150 nearest a reading location 154 will provide an indication of the angle of the perforating charges 102 from vertical. As illustrated in FIG. 4A, the reference numerical indicator 150*a* is nearest the reading location 154, which indicates that the perforating charges 102 are oriented at a 0° angle from vertical.

The end fixture 142 includes a radial notch 156 defined therein, which may be aligned with a tab 158 extending longitudinally from the charge carrier 120. The tab 158 may be radially disposed with a predetermined offset from aligned with lateral openings 160 in the charge carrier 120 from which the perforating charges 102 protrude. The notch 156 and the tab 158 cooperate to ensure that the end fixture 142 is installed with the reference numerical indicator 150*a* aligned with the perforating charges 102. If an operator inadvertently attempted to install the end fixture 142 in an improper orientation, the tab 158 would interfere with the end fixture 142 and prevent installation. Once installed, the end fixture 142 does not interfere with the operation of the perforating charges 102, and thus, the end fixture 142 need not be removed before deployment into the wellbore 12 (FIG. 1). An operator will be able to look down the inside of the gun body 104 (FIG. 3A) at any time after the charge carrier 102 is loaded to view the numerical indicators 150 and hatch marks 152.

As illustrated in FIG. 4B, the end fixture 142 and includes openings 162*a*, 162*b*, 162*c* defined therein. The openings 162*a*, 162*b*. 162*c* may receive fasteners (not shown) for coupling the end fixture 142 to the charge carrier 120 (FIG. 4A), for the passage of detonator cord, electrical conductors, or for coupling other equipment to the end fixture 142. The numerical indicators 150 and hatch marks 152 may remain visible to an operator around the perimeter of the end fixture 142 when all equipment is attached.

Figure 5A:
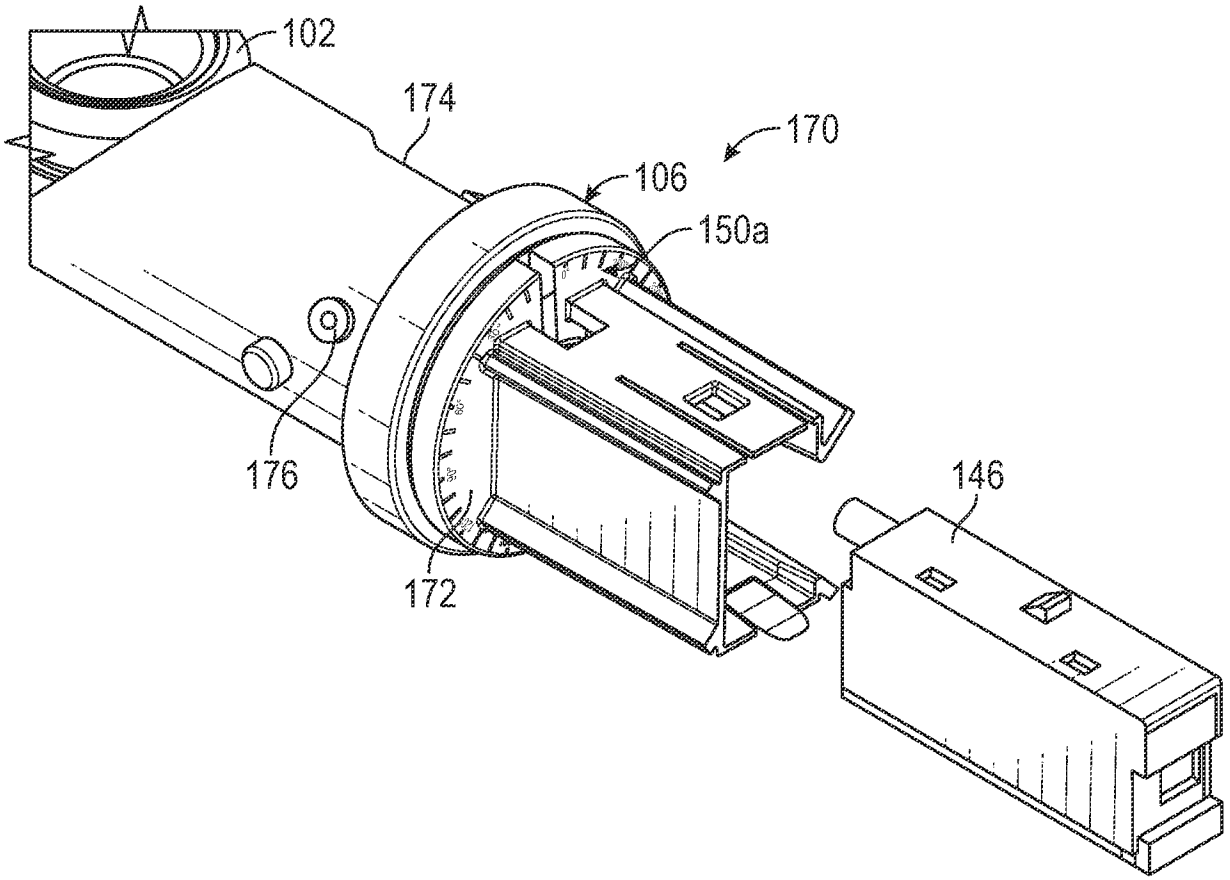
FIGS. 5A and 5B are front and rear partial perspective views of another orientation verification tool including an asymmetrical fastener pattern for securing the orientation verification tool to a charge carrier in a single orientation.
Figure 5B:
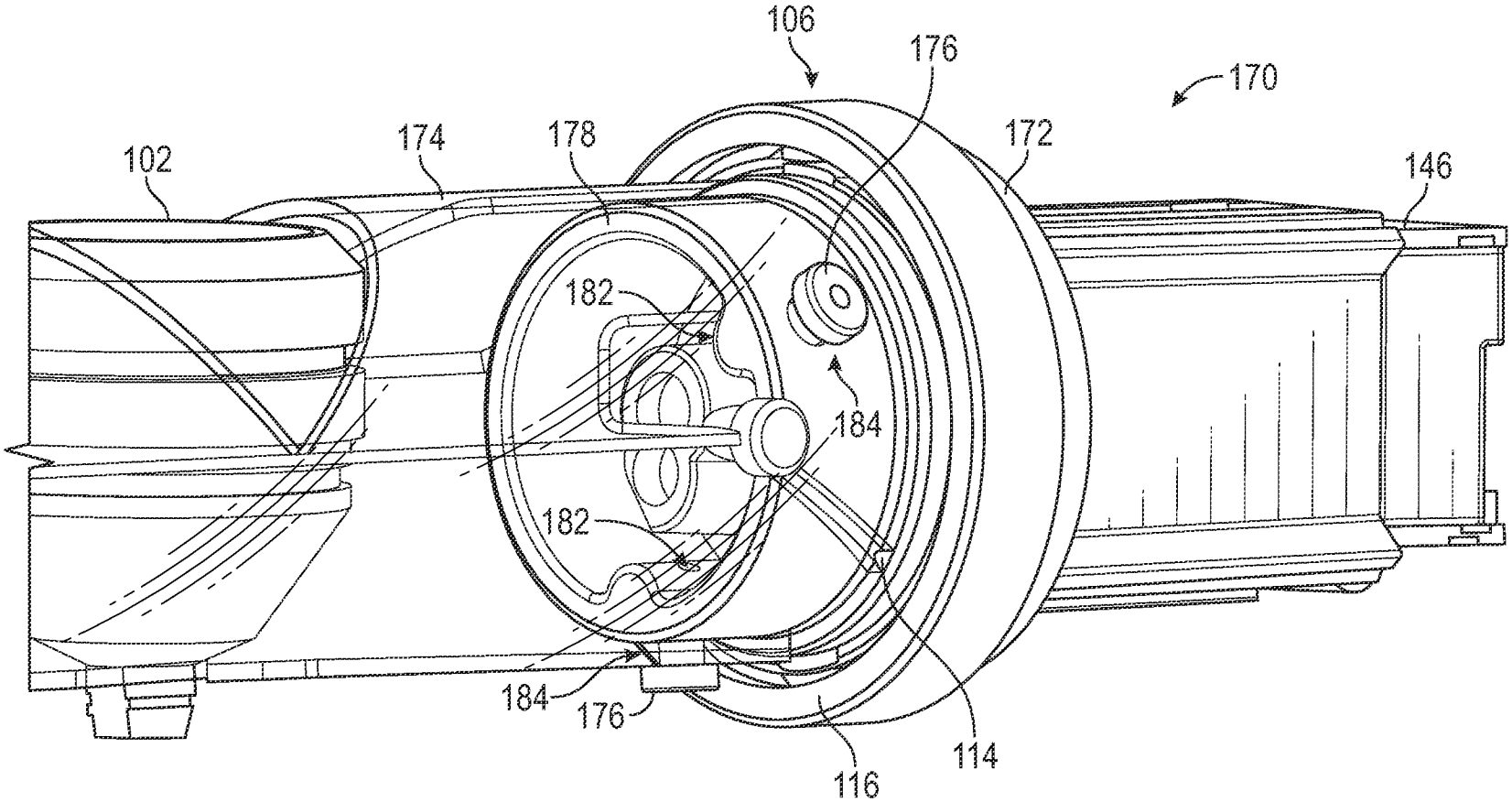

Referring to FIGS. 5A and 5B, an orientation verification tool 170 includes an end fixture 172 for receiving a detonator 146, similar to the orientation verification tool 140 (FIG. 4A) described above. The end fixture 172 is coupled to a charge carrier 174 by an asymmetrical array of fasteners 176, ensuring that the end fixture 172 is coupled to the charge carrier 174 in the correct orientation.

The end fixture 172 includes a circular boss 178 extending through inner and outer rings 114, 116 of swivel device 106 and into the charge carrier 174. The circular boss 178 may be rotationally fixed to the inner ring 114 and the charge carrier 174. The circular boss 178 includes a pair of fastener receptacles such as threaded radial bores 182 radially spaced from one another in an asymmetric array. For example, the radial bores 182 may be spaced from one another at a 110-degree angle such that the radial bores 182 align with a pair of similarly spaced through bores 184 defined in the charge carrier 174. Only when the end fixture 172 is properly oriented with respect to the charge carrier 174 will both the radial bores 182 align with both of the through bores 184 to permit both the fasteners 176 to be received in the corresponding radial bores 174 to couple the fasteners 176, the charge carrier 174 and the end fixture 172 together. Thus, if both fasteners 176 are installed in a respective pair of bores 182, 184, the end fixture 172 is installed in an orientation where the reference numerical indicator 150*a* is aligned with the perforating charges 102.

In other embodiments (not shown), other types of fasteners may be arranged in an asymmetrical array to ensure the end fixture is properly oriented with respect to the charge carrier. For example, an end fixture may include an asymmetrical array of clips, pins rivets, bolts, etc. coupled thereto to be received in a corresponding asymmetrical array of slots, posts, nuts, or other faster receptacles defined on a charge carrier. In other embodiments (not shown), the fasteners may be coupled to the charge carrier in an asymmetrical array, and the fastener receptacles may be defined on the end fixture in a corresponding asymmetrical array without departing from the scope of the disclosure. In any case, alignment of the fasteners with the fastener receptacles ensures proper alignment between the end fixture and the charge carrier.

Figure 5C:
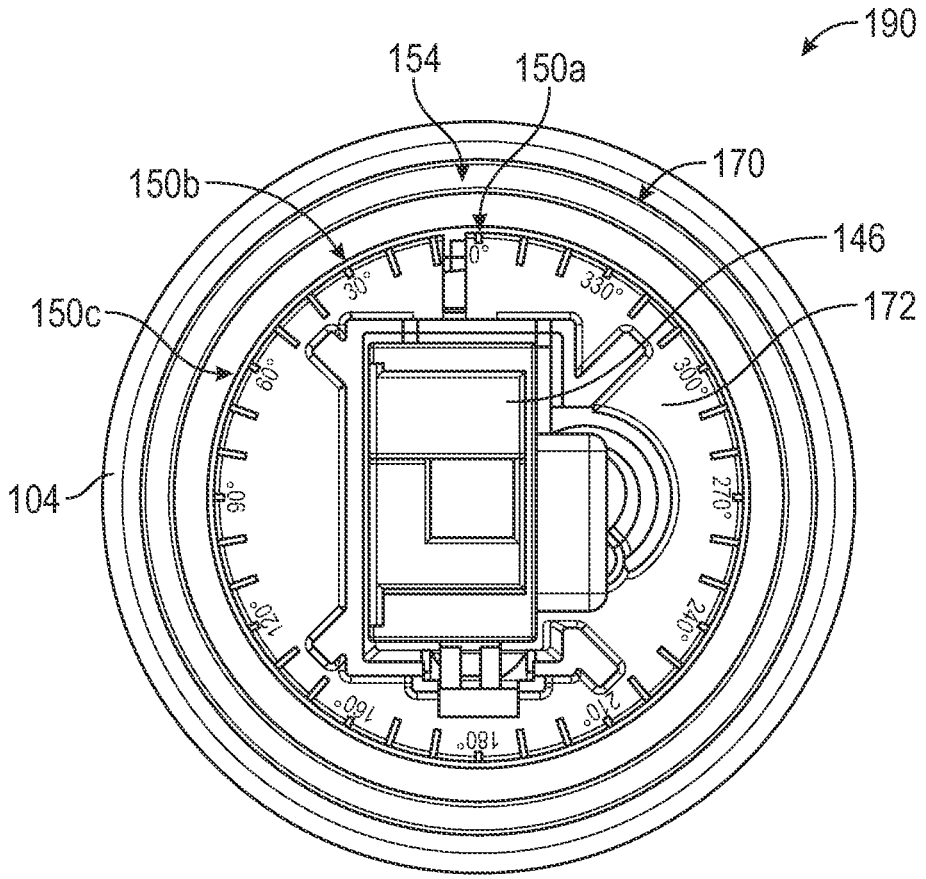
FIG. 5C is an end view of a perforating gun assembly including the orientation verification tool of FIG. 5A secured to a gun body.

As illustrated in FIG. 5C, the reference numerical indicator 150*a* is visible to an operator from a longitudinal end of perforating gun assembly 190. Even when the charge carrier 174 (FIG. 5B) is installed within gun body 104, an operator may ascertain the orientation of the perforating charges 102 (FIG. 5B) by identifying the numerical indicator 150*a* nearest the reading location 154. The numerical indicators 150 are visible around the perimeter of the end fixture 172 even when the detonator 146 is installed therein.

Figure 6:
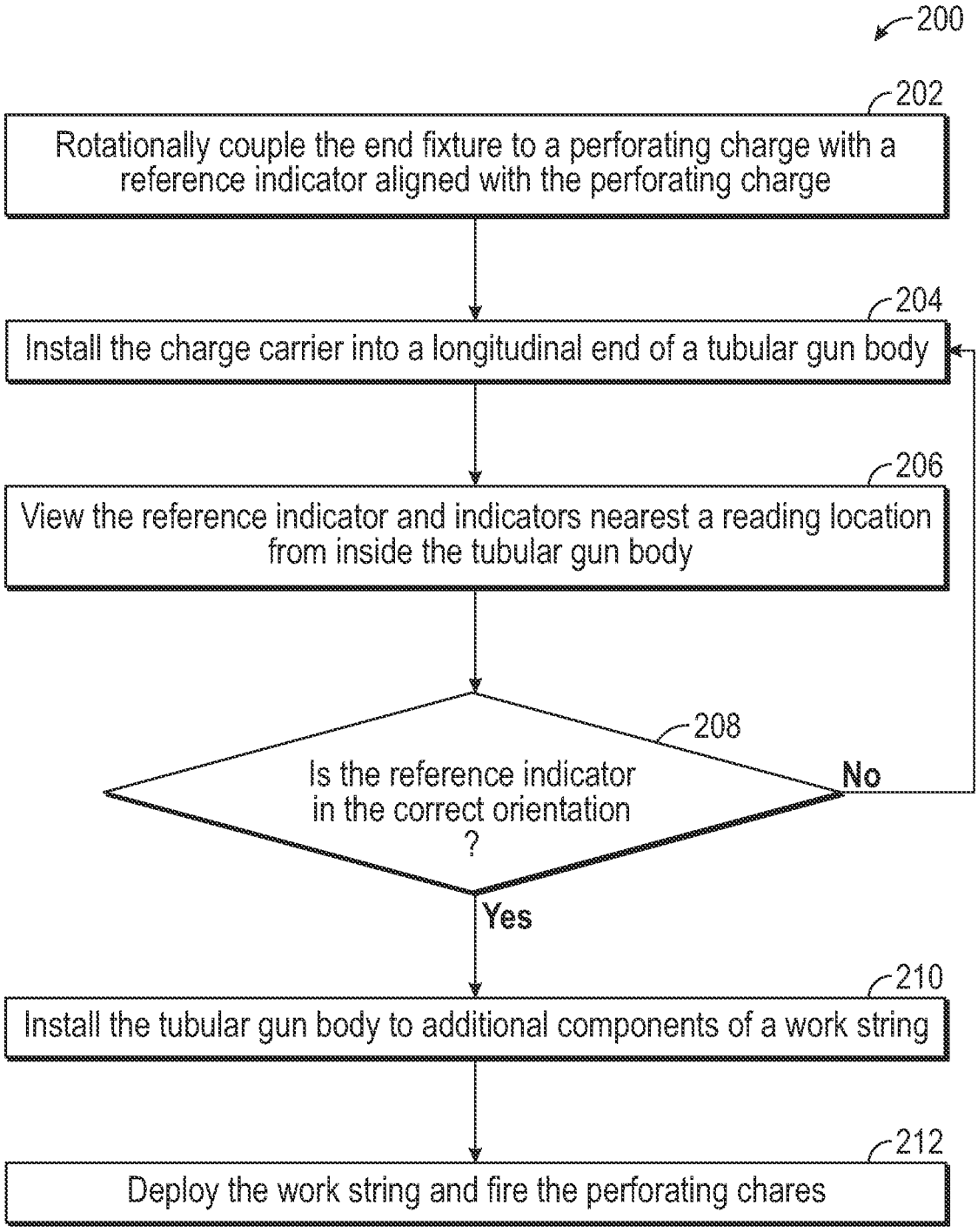
FIG. 6 is a flowchart illustrating a method of installation and use of an orientation verification tool in connection with a perforating gun assembly in accordance with aspects of the present disclosure.

Referring to FIG. 6, a method 200 of installation and use of an orientation verification tool in connection with a perforating gun assembly is illustrated. Initially at step 202, an end fixture is coupled to a longitudinal end of a charge carrier such that the end fixture is rotationally coupled to at least one perforating charge in the charge carrier. The end fixture is coupled such that a reference indicator is aligned with the at least one perforating charge about a rotational axis. To ensure the end fixture is coupled to the charge carrier in the correct orientation, an operator may verify that each fastener in an asymmetrical fastener array is installed, and/or that a tab extending from one of the end fixture and charge carrier is received in a corresponding slot on the other of the end fixture and the charge carrier. Once the end fixture is installed, the reference indicator is visible from a longitudinal end of the charge carrier along with a plurality of visual indicators radially spaced around a perimeter of the end fixture.

At step 204, the charge carrier is inserted into an opening of a tubular gun body at a longitudinal end of the tubular gun body. Once the charge carrier is inserted, perforating charges protruding form lateral openings in the charge carrier may be obscured by the tubular gun body. The end fixture and may remain visible from the opening in which the charge carrier was inserted. Thus, an operator may view the reference indicator and other visual indicators on the end fixture from within the tubular gun body (step 206) to ascertain the orientation of the perforating charges in the tubular gun body at decision 208. If the visual indicators nearest a reading location, such as the top of the tubular gun body, indicate that the perforating charges are not in the correct orientation, the method 200 returns to step 204. The charge carrier may be removed from the tubular gun body and reinstalled correctly. If the visual indicators nearest the reading location indicate that the perforating charges are in the correct orientation, the correct orientation of the charge carrier may be recorded and the method 200 proceeds to step 210 where additional charge carriers may be inserted into the tubular gun body or other equipment may be assembled into a work string. At step 212, the work string may be deployed into a wellbore and the perforating charges may be fired in the correct orientation.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to one aspect, the disclosure is directed to a perforating gun apparatus. The perforating gun apparatus includes a charge carrier defining a rotational axis and at least one perforating charge coupled to the charge carrier. The at least one perforating charge defines a lateral discharge direction. An end fixture is coupled to a longitudinal end of the charge carrier and rotationally coupled to the charge carrier about the rotational axis. The end fixture defines a longitudinal end face with a visual reference indicator marked thereon in alignment with the lateral discharge direction of the at least one perforating charge.

In one or more embodiments, the longitudinal end face of the end fixture further includes a plurality of visual indicators radially spaced around a perimeter thereof. The plurality of visual indicators may include at least one numerical indicator corresponding to an angular position of the at least one numerical indicator from the reference indicator.

In some embodiments the perforating gun apparatus further includes a plurality of fasteners coupled to one of the end fixture and the charge carrier in an asymmetrical array, and the other one of the end fixture and the charge carrier includes a corresponding asymmetrical array of fastener receptacles such that alignment of the array of fasteners with the array of fastener receptacles ensures alignment between the reference indicator on the end fixture with the lateral discharge direction of the at least one perforating charge. In some embodiments, a tab protrudes from one of the charge carrier and the end fixture into a corresponding slot disposed in the same circumferential orientation on the other of the charge carrier and the end fixture to ensure proper alignment between the charge carrier and the end fixture.

In one or more embodiments, the end fixture includes a detonator sleeve protruding longitudinally from the longitudinal end face of the end fixture. In some embodiments, the perforating gun apparatus further includes a swivel device coupled to the charge carrier, the swivel device including inner and outer rings rotatably supporting the charge carrier about the rotational axis. In some embodiments, the perforating gun apparatus further includes a tubular gun body disposed around the charge carrier, the tubular gun body including an opening at a longitudinal end thereof through which the reference indicator is visible.

According to another aspect, the disclosure is directed to a perforating gun system. The perforating gun system includes a work string deployable into a wellbore, a charge carrier coupled in the work string and defining a rotational axis, at least one perforating charge coupled to the charge carrier, the at least one perforating charge defining a lateral discharge direction and an end fixture coupled to a longitudinal end of the charge carrier and rotationally coupled to the charge carrier about the rotational axis. The end fixture defines a longitudinal end face with a visual reference indicator marked thereon in alignment with the lateral discharge direction of the at least one perforating charge.

In some embodiments, the perforating gun system further includes a swivel device rotatably supporting the charge carrier about the rotational axis in the wellbore, and wherein a center of gravity of the charge carrier is laterally offset from the rotational axis. In some embodiments, the charge carrier includes at least one lateral opening through which the at least one perforating charge protrudes. The system may further include a tubular gun body disposed around the charge carrier.

In one or more embodiments, the longitudinal end face includes a plurality of numerical indicators corresponding to respective an angular position of the respective numerical indicators from the reference indicator. The system may further include a detonator sleeve protruding longitudinally from the longitudinal end face and circumscribed by the plurality of numerical indicators.

In some embodiments, the end fixture includes a key or slot to be engaged with a corresponding key or slot on the charge carrier such that the key or slot interferes with installation of the end fixture to the charge tube in an improper orientation. In some embodiments, the system includes a plurality of perforating guns coupled to one another in series.

In another aspect, the disclosure is directed to a method of assembling and operating a perforating gun apparatus. The method includes aligning a visual reference indicator on a longitudinal end face of an end fixture with a lateral discharge direction defined by at least one perforating charge on a charge carrier, rotationally coupling the end fixture to a longitudinal end of the charge carrier, inserting the charge carrier into an opening at a longitudinal end of a tubular gun body, viewing the longitudinal end face of the end fixture through the opening at the longitudinal end of the tubular gun body and thereby ascertaining an orientation of the at least one perforating charge and recording the orientation of the at least one perforating charge within the tubular gun body.

In some embodiments, aligning the visual reference indicator with the lateral discharge direction includes coupling the charge carrier to the end fixture with an asymmetrical fastener array. In some embodiments, the method further includes identifying one of a plurality of visual reference indicators spaced around a perimeter of the end fixture that is nearest a predetermined reading location. The method may further include removing the charge carrier from the tubular gun body prior to installing the tubular gun body to additional components of a work string in response to identifying an incorrect visual indicator nearest the reading location.

In one or more embodiments, the method further includes installing the tubular gun body to additional components of a work string subsequent to recording the orientation of the at least one perforating charge within the tubular gun body. The method may further includes deploying the work string into a wellbore and discharging the at least one perforating charge within the wellbore.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A perforating gun apparatus, comprising:

a charge carrier defining a rotational axis;

at least one perforating charge coupled to the charge carrier, the at least one perforating charge defining a lateral discharge direction;

an end fixture coupled to a longitudinal end of the charge carrier and rotationally coupled to the charge carrier about the rotational axis, the end fixture defining a longitudinal end face with a visual reference indicator marked thereon in alignment with the lateral discharge direction of the at least one perforating charge.

2. The apparatus of claim 1, wherein the longitudinal end face of the end fixture further comprises a plurality of visual indicators radially spaced around a perimeter thereof.

3. The apparatus of claim 2, wherein the plurality of visual indicators includes at least one numerical indicator corresponding to an angular position of the at least one numerical indicator from the reference indicator.

4. The apparatus of claim 1, further comprising a plurality of fasteners coupled to one of the end fixture and the charge carrier in an asymmetrical array, and wherein the other one of the end fixture and the charge carrier includes a corresponding asymmetrical array of fastener receptacles such that alignment of the array of fasteners with the array of fastener receptacles ensures alignment between the reference indicator on the end fixture with the lateral discharge direction of the at least one perforating charge.

5. The apparatus of claim 1, wherein the end fixture includes a detonator sleeve protruding longitudinally from the longitudinal end face of the end fixture.

6. The apparatus of claim 1, further comprising a swivel device coupled to the charge carrier, the swivel device including inner and outer rings rotatably supporting the charge carrier about the rotational axis.

7. The apparatus of claim 1, further comprising a tubular gun body disposed around the charge carrier, the tubular gun body including an opening at a longitudinal end thereof through which the reference indicator is visible.

8. A perforating gun system, comprising:

a work string deployable into a wellbore;

a charge carrier coupled in the work string and defining a rotational axis;

at least one perforating charge coupled to the charge carrier, the at least one perforating charge defining a lateral discharge direction;

an end fixture coupled to a longitudinal end of the charge carrier and rotationally coupled to the charge carrier about the rotational axis, the end fixture defining a longitudinal end face with a visual reference indicator marked thereon in alignment with the lateral discharge direction of the at least one perforating charge.

9. The system of claim 8, further comprising a swivel device rotatably supporting the charge carrier about the rotational axis in the wellbore, and wherein a center of gravity of the charge carrier is laterally offset from the rotational axis.

10. The system of claim 8, wherein the charge carrier includes at least one lateral opening through which the at least one perforating charge protrudes and wherein the system further comprises a tubular gun body disposed around the charge carrier.

11. The system of claim 8, wherein the longitudinal end face includes a plurality of numerical indicators corresponding to respective an angular position of the respective numerical indicators from the reference indicator.

12. The system of claim 11, further comprising a detonator sleeve protruding longitudinally from the longitudinal end face and circumscribed by the plurality of numerical indicators.

13. The system of claim 8, wherein the end fixture includes a key or slot to be engaged with a corresponding key or slot on the charge carrier such that the key or slot interferes with installation of the end fixture to the charge tube in an improper orientation.

14. The system of claim 8, wherein the work string includes a plurality of perforating guns coupled to one another in series.

15. A method of assembling and operating a perforating gun apparatus, the method comprising:

aligning a visual reference indicator on a longitudinal end face of an end fixture with a lateral discharge direction defined by at least one perforating charge on a charge carrier;

rotationally coupling the end fixture to a longitudinal end of the charge carrier;

inserting the charge carrier into an opening at a longitudinal end of a tubular gun body;

viewing the longitudinal end face of the end fixture through the opening at the longitudinal end of the tubular gun body and thereby ascertaining an orientation of the at least one perforating charge; and recording the orientation of the at least one perforating charge within the tubular gun body.

16. The method of claim 15, wherein aligning the visual reference indicator with the lateral discharge direction comprises coupling the charge carrier to the end fixture with an asymmetrical fastener array.

17. The method of claim 15, further comprising identifying one of a plurality of visual reference indicators spaced around a perimeter of the end fixture that is nearest a predetermined reading location.

18. The method of claim 17, further comprising removing the charge carrier from the tubular gun body prior to installing the tubular gun body to additional components of a work string in response to identifying an incorrect visual indicator nearest the reading location.

19. The method of claim 15, further comprising installing the tubular gun body to additional components of a work string subsequent to recording the orientation of the at least one perforating charge within the tubular gun body.

20. The method of claim 19, further comprising deploying the work string into a wellbore and discharging the at least one perforating charge within the wellbore.

* * * * *